United States Patent [19]

Kojima

[11] Patent Number: 4,996,995

[45] Date of Patent: Mar. 5, 1991

[54] ASHTRAY

[75] Inventor: Yoshikazu Kojima, Urawa, Japan

[73] Assignee: Kobishi Electric Co., Ltd., Tokyo, Japan

[21] Appl. No.: 310,736

[22] Filed: Feb. 14, 1989

[30] Foreign Application Priority Data

Jun. 27, 1988 [JP] Japan ..... 63-84856[U]

[51] Int. Cl.[5] ..... A24F 19/10

[52] U.S. Cl. ..... 131/238; 131/231

[58] Field of Search ..... 131/238, 242, 231

[56] References Cited

U.S. PATENT DOCUMENTS

| | | | |
|---|---|---|---|
| 2,788,085 | 4/1957 | Waller | 131/238 X |
| 3,166,080 | 1/1965 | Neale | 131/242 X |
| 3,516,232 | 6/1970 | Gilbertson | 131/238 X |
| 3,519,002 | 7/1970 | Davis | 131/242 X |
| 3,860,404 | 1/1975 | Jochimski | 131/238 X |
| 4,043,776 | 8/1977 | Orel | 131/238 X |
| 4,177,045 | 12/1979 | Orel | 131/238 X |

FOREIGN PATENT DOCUMENTS

| | | | |
|---|---|---|---|
| 55-70321 | 5/1980 | Japan . | |
| 55-29139 | 8/1980 | Japan . | |
| 57-197897 | of 1982 | Japan . | |
| 57-106425 | 6/1982 | Japan . | |
| 58-86230 | 6/1983 | Japan . | |
| 60-119911 | 8/1985 | Japan . | |
| 61-20199 | 2/1986 | Japan . | |
| 162165 | 7/1986 | Japan | 131/238 |
| 177973 | 8/1986 | Japan | 131/238 |
| 61-167796 | 10/1986 | Japan . | |
| 62-7897 | 1/1987 | Japan . | |
| 62-21897 | 2/1987 | Japan . | |
| 62-122597 | 8/1987 | Japan . | |
| 62-136234 | 8/1987 | Japan . | |
| 7801748 | 9/1979 | Sweden | 131/238 |

*Primary Examiner*—V. Millin
*Assistant Examiner*—D. Crosby
*Attorney, Agent, or Firm*—Darby & Darby

[57] ABSTRACT

An ashtray which has a main body including a tray for receiving ashes and a housing having an opening facing upwardly for housing the tray therein, a lid member for covering the opening of the housing therewith, a hinge assembly for rotatably connecting the lid member to the main body, an air cleaning means disposed at the lid member for removing impurities from the air, the air cleaning means including a fan for exhausting the air, a drive means for driving the fan and an air cleaner for removing impurities from the air and a light means for lighting the main body and the lid member. The ashtray can be used in a dimly-lit-place as well as in a well-lit place, and is able to clean the air by removing impurities, including smoke emitted from cigarettes or other smoking materials.

12 Claims, 2 Drawing Sheets

ASHTRAY

BACKGROUND OF THE INVENTION

1. Field of the Invention

The present invention relates to an ashtray which has a light means for lighting itself in a dimly-lit place, in addition to having an air cleaning means for cleaning air and removing smoke or fumes.

2. Prior Art

Smoking places and times are currently being progressively limited on the basis of research as to the harmful substances which are included in the smoke emitted from cigarettes. In such circumstances, it is required that the harmful substances are removed from smoke.

In order to respond to the requirements, there are conventional smokeless ashtrays having air cleaning means.

The ashtray, for example, comprises a main body including a tray for receiving ashes from the cigarettes and a housing having an upwardly-opening recess for housing the tray therein, a lid member for covering the recess of the main body, a hinge assembly for connecting rotatably the lid member to the main body, and an air cleaning means mounted in the lid member for cleaning the air and removing impurities such as smoke, fumes and the like. The air cleaning means includes a drive means disposed at an outer face of the lid member so that its driveshaft is crossed at right angles with the outer face, a fan rotatably disposed on the driveshaft protruded from the lid member and an air cleaner for removing impurities from the air.

In the ashtray, smoke emitted from cigarettes is cleaned by the air cleaner and then exhausted as cleaned air through the lid member by the fan.

However, the conventional ashtray cannot be easily used in a dimly-lit place such as a bedroom, a living room and the like because it is difficult to find.

SUMMARY OF THE INVENTION

Accordingly, it is an object of the present invention to provide an ashtray which can be used in a dimly-lit place as well as in a well-lit place, and which is in addition able to clean air and remove smoke emitted from smoking materials.

According to an aspect of the present invention, there is provided an ashtray comprising:

(a) a main body including a tray for receiving ashes and a housing having an opening facing upwardly for housing the tray therein;

(b) a lid member for covering the opening of the housing therewith;

(c) a hinge assembly for connecting rotatably the lid member to the main body;

(d) an air cleaning means disposed at the lid member for removing impurities from the air, the air cleaning means includes:

(d-1) a fan for exhausting the air;

(d-2) a drive means for driving the fan; and (d-3) an air cleaner for removing impurities from the air; and (e) a light means for lighting at least the main body.

BRIEF DESCRIPTION OF THE DRAWING

The invention will now be described with reference to the accompanying drawings wherein.

DESCRIPTION OF THE PREFERRED EMBODIMENTS OF THE INVENTION

Figure 1:
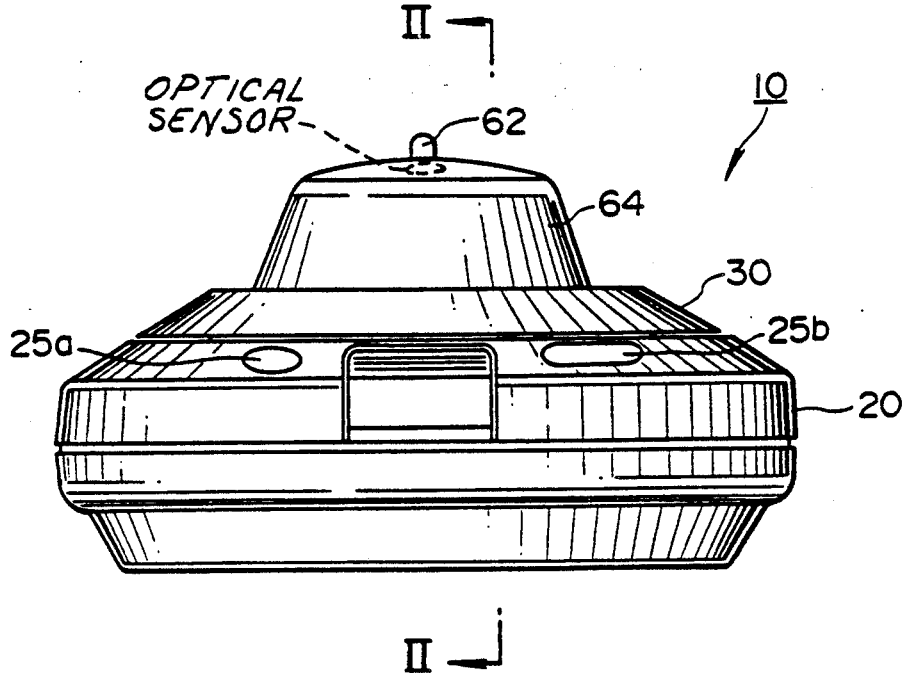
FIG. 1 is a front view showing an ashtray of the present invention.
Figure 2:
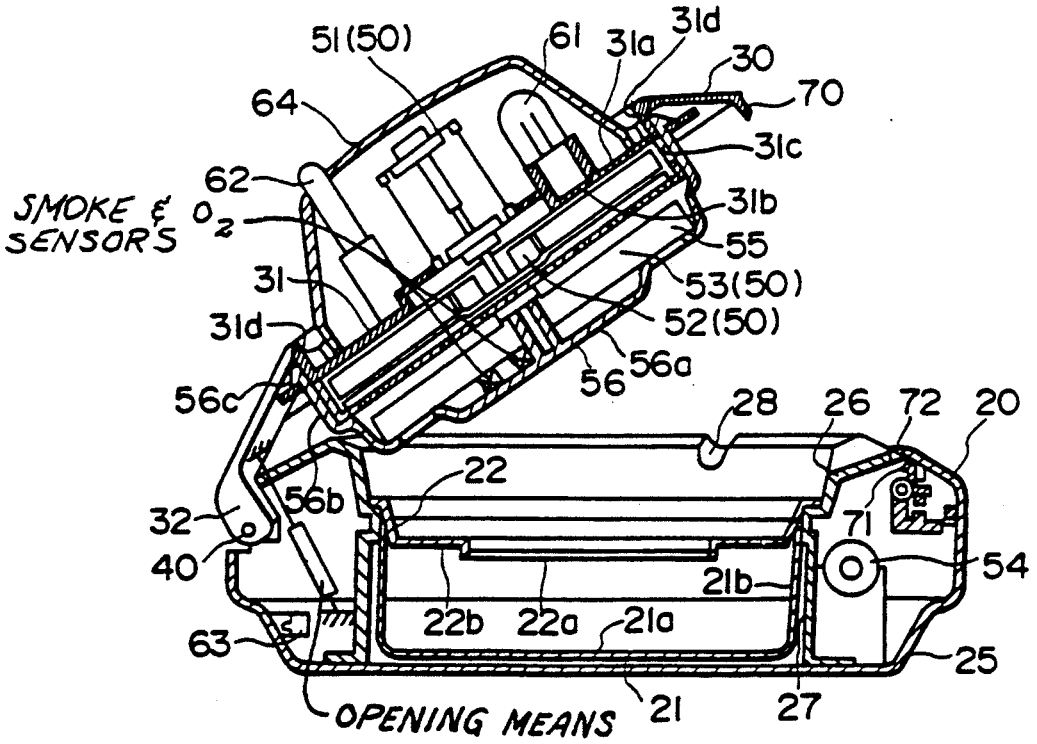
FIG. 2 is a cross-sectional view taken along line II—II in FIG. 1.
Figure 3:
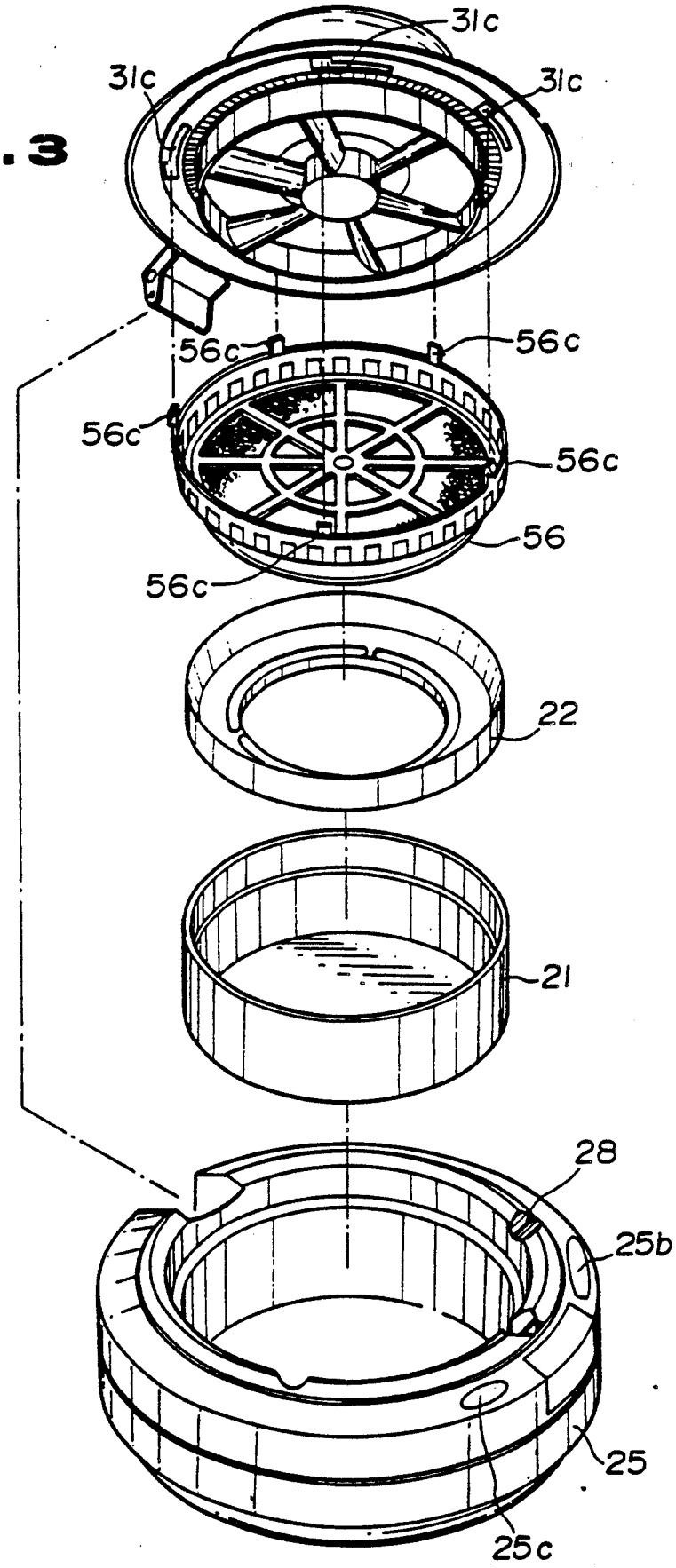
FIG. 3 is an exploded view of the ashtray of FIG. 1.

FIGS. 1 and 2 illustrate an ashtray according to the present invention. Reference numeral 10 denotes an ashtray which comprises a main body 20 including a substantially cylindrical shaped tray 21 for receiving ashes from cigarettes or other smoking materials and an essentially cylindrical housing 25 for housing the tray 21 therein so as to be coaxial therewith, a lid member 30 having a truncated conical structure for covering an upper portion of the housing 25, a hinge assembly 40 for connecting rotatably the lid member 30 to the housing 25, an air cleaning means 50 for removing impurities from the air, such as smoke emitted from cigarettes and a light means including a light bulb 61 for lighting the main body 20 and/or the lid member 30 so that the unit can be located even in a dimly-lit area. A small peripheral gap separates the lid 30 from the main body 20 when the ashtray is in the covered condition illustrated in FIG. 1.

As shown in FIG. 2, the tray 21 of the main body 20 includes a bottom 21*a* and a peripheral wall 21*b* upwardly formed at a periphery of the bottom 21*a*. A ring shaped dish 22 is placed on an upper peripheral portion or a rim of the tray 21. The dish 22 includes a perforated opening 22*a* at the center thereof and a stage 22*b* formed radially outward at the circumferential portion of the opening 22*a*. The dish 22 is larger in its largest diameter than the tray 21.

The housing 25 has upwardly-opening first and second cylindrical segments 26 and 27 formed at a center thereof. The second cylindrical segment 27 for housing the tray 21 therein is formed at a bottom of the first cylindrical segment 26 for housing a part of the air cleaning means 50 therein. The first cylindrical 26 is larger in an inner diameter than the second cylindrical segment 27. Also, a plurality of cigarette rests 28 of a semi-cylindrical configuration are radially formed at the rim of the housing 25 in the peripheral direction at equal angular intervals about the center of the housing 25. Each of the grooves 28 is used as a place on which, for example, cigarettes, are temporarily placed. Also, as shown in FIG. 1, the housing 25 has an indicator light 25*a* such as a light emitting diode, and a clock 25*b* such as a digital clock, disposed at the rim face thereof.

The lid member 30 having the truncated conical shape includes smaller and larger faces and a skirt for connecting between peripheries of the smaller and larger faces. The smaller and larger faces are depressed so as to be close to each other. As a result, a circular shaped central portion 31 is defined by the depressed smaller and larger faces or upper and lower faces 31*a* and 31*b*.

At the central portion 31 of the lid member 30, the air cleaning means 50 is disposed. The air cleaning means 50 includes a DC motor 51 mounted on a center of the upper face 31*a* of the central portion 31 so that its driveshaft is crossed at right angles with the upper face 31*a*, a fan 52 rotatably attached to the driveshaft of the DC motor 51 protrudes from the central portion 31 so as to be rotated therewith, an air cleaner 53 placed at a lower position than the fan 52 in a space therebetween and a battery or cell 54 disposed in the housing 25 for supplying power to the DC motor 51. In this embodiment, the air cleaner 53 comprises a mass of granular activated carbon (not shown), a net 55 having numerous small openings for retaining the activated carbon therein, each of the openings being smaller in size than the activated carbon granules, and a retaining member 56 for retaining the net 55. The retaining member 56 essentially having a U-shaped vertical cross-section comprises a grille 56*a* of a circular horizontal cross-section including opposite faces having plural air vents or apertures and a circumferential wall for connecting both faces, a peripheral wall 56*b* having a plurality of air vents formed upwardly at an upper portion of the circumferential wall at equal angular intervals about a center of the retaining member 56 and plural stoppers 56*c* having two ends upwardly formed at an upper portion of the peripheral wall 56*b* at equal angular intervals about the center of the retaining member 56. Each of the stopper 56*c* has opposite ends. One end of the stoppers 56*c* is mounted on the peripheral wall 56*b* and the other end has a hook radially outward thereof for engaging a substantially inverted L-shaped aperture 31*c* formed at the lower face 31*b* of the lid member 30. When the retaining member 56 is attached to the lid member 30, an inner space for housing the fan 52 attached to the driveshaft of the DC motor 51 therein is defined by the lower face 31*b* of the lid member 30 and the grille 56*a* and the stoppers 56*c* of the retaining member 56.

Further as to the air cleaning means 50, a plurality of outlets 31*d* for ventilation are formed at a periphery of the central portion 31 of the lid member 30 at equal angular intervals about a center thereof. In the air cleaning means 50, air forced through the grille 56*a* of the retaining member 56 by the fan 52 is passed through the air cleaner 53 and smoke, etc., is removed from the air. As a result, cleaned air is obtained and exhausted through the outlets 31*d* of the lid member 31 to the ambient space.

Meanwhile, the main body 20 and the lid member 30 are rotatably connected with the hinge assembly 40 as shown in FIG. 2. Specifically, a connecting portion 32 formed downwardly and outward extending from the central portion 31 of the lid member 30 is rotatably connected to a side portion of the housing 25 by means of the hinge assembly 40 such as a screw and/or the like. In this embodiment, a holding means (not shown) for holding upwardly the lid member 30 so as to be opened at a predetermined angle defined by the lid member 30 and the housing 25, is disposed in the housing 25. The holding means may include an air damper an oil damper or the like.

Also, the lid member 30 has a first stop means 70 formed at a position of the lower periphery of the skirt thereof for engaging with a second stop means 71 formed in the housing 25 through a gap 72 formed at the rim of the housing 25 to hinder the lid member 30 from opening. When the first stop means 70 is disengaged with the second stop means 71, power is supplied to the DC motor 51 of the air cleaning means 50 and the indicator light 25*a*.

As for the light means, this means comprises an incandescent lamp 61 disposed on the central portion 31 of the lid member 30 close to the DC motor 51, a light switch 62 disposed on the central portion 31 close to the lamp 61 and a battery or cell 54 disposed in the housing 25 for supplying power to the lamp 61. In this embodiment, a power feed 63 for supplying power from an external AC power source (not shown) to the lamp 61 through a DC/AC converter (not shown) or to the DC motor 51 is disposed in the housing 25. When the external power source supplies power to the light means or the air cleaning means 50, the power feed 63 can be used as a plug.

Also, the lamp 61 of the light means and the DC motor 51 of the air cleaning means 50 is covered with a substantially inverted U-shaped lampshade 64 made of translucent materials. The lampshade 64 is smaller in diameter than the central portion 31 of the lid member 30. An aperture for passing an upper portion of the light switch 62 through is formed through the lampshade 64. Also, the color of the lampshade 64 is determined on the basis of the atmosphere of the place where the ashtray 10 is used. The colors include red, pink, blue, yellow, purple and the like.

With the above described ashtray 10, when the first stop means 70 is disengaged with the second stop means 71, power is supplied to the DC motor 51 of the air cleaning means 50 to rotate the fan 52 and light the indicator light 25*b*. Smoke emitted from cigarettes can be removed from the air, and the ashtray 10 can be found in a dark place because the lamp 61 activated by the light switch 62 can light itself. Therefore, it illuminates the clock 25*b* disposed at the main body 20 because the light of the lamp 61 is reflected on the clock.

In the above described embodiment, although the light switch 62 is used when the lamp 61 is activated, an optical sensor (not shown) may be used instead of the light switch 62. The optical sensor for detecting darkness to direct the lamp 61 to light can be disposed on the lid member 30 and/or the main body 20. In this embodiment, the ashtray 10 can automatically be used in a dimly-lit place without operating the light switch 62. Also, the optical sensor may have a function of measuring the light level to direct the lamp 61 to light.

The ashtray 10 may further have one or more smoke sensors (not shown) disposed in plural air passes defined by the air cleaning means 50 for detecting smoke to direct the air cleaning means 50 to drive. In this embodiment, because the air cleaning means 50 can be driven only when smoke is detected by the smoke sensor, the power of the battery 54 can be conserved. Also, the smoke sensor may have a function of measuring the amount of smoke to direct the air cleaning means 50 to drive.

Furthermore, the ashtray 10 may have one or more oxygen meters (not shown) disposed in plural air passes of the air cleaning means 50 for detecting oxygen deficiency in the air passages to direct the air cleaning means 50 to drive. In this embodiment, because the air cleaning means 50 can be driven when the oxygen deficiency in the air passages is detected by the oximeters, it can promptly prevent the ashtray 10 from smothering the smoking materials. Furthermore, the oximeter may have a function of measuring the amount of oxygen to direct the air cleaning means 50 to drive.

Also, the ashtray 10 may have a transformer (not shown) disposed at a point midway between the lamp 61 and the battery 54 or the external power source for transforming power which is supplied from the battery 54 or the external power source to the lamp 61. In this embodiment, when the lamp 61 is used as a mood lamp, the voltage between the lamp 61 and the battery 54 or the external power source can be controlled by the transformer so that the lamp 61 lowers its brightness.

I claim:

1. An ashtray comprising:

a main body including a tray for receiving ashes and a housing having an opening facing upwardly for housing the tray therein;

a lid member for covering the opening of the housing therewith, at least a portion of said lid being translucent;

a hinge assembly for rotatably connecting the lid member to the main body;

air cleaning means disposed at the lid member for removing impurities from the air, the air cleaning means including;

a fan for exhausting the air;

drive means for driving the fan; and an air cleaner for removing impurities from the air; and light means including a lamp for lighting at least a portion of the main body, said lamp being positioned in said lid to allow light to pass through said translucent lid portion and illuminate the surrounding space and said main body portion when said lamp is lit; and means for turning on said light means and said air cleaning means when said lid member is in an open position and for turning off said light means and said air cleaning means when said lid member is in a closed position.

2. An ashtray according to claim 1, wherein the air cleaner is an air filter.

3. An ashtray according to claim 1, wherein the air cleaner includes activated carbon granules.

4. An ashtray according to claim 1 further comprises a battery housed in the main body for supplying power to the drive means.

5. An ashtray according to claim 1 further comprises a power feed for supplying power from an external power source to the drive means.

6. An ashtray according to claim 1 further comprises holding means disposed at the hinge assembly for holding the lid member upwardly over so that the lid member is opened at a predetermined angle which is defined between the lid member and the main body and a force applied to for means hindering the lid member from opening against a force applied to the opening means.

7. An ashtray according to claim 6, wherein the holding means includes an air damper.

8. An ashtray according to claim 6, wherein the holding means includes an oil damper.

9. An ashtray according to claim 1 further comprising an externally visible clock mounted on a face of the main body which is illuminated by the light means.

10. An ashtray according to claim 1 further comprises an optical sensor for detecting darkness to direct the light means to light.

11. An ashtray according to claim 1 further comprises at least one smoke sensor disposed in plural air passages defined in the air cleaning means for detecting smoke and causing the air cleaning means to operate.

12. An ashtray according to claim 1 further comprises at least one oxygen meter disposed in plural air passages defined in the air cleaning means for detecting oxygen deficiency in the air and causing the air cleaning means to operate.

* * * * *